United States Patent [19]

Driscoll

[11] 4,195,443

[45] Apr. 1, 1980

[54] JALOUSIE BURGLAR STOP

[76] Inventor: Patrick V. Driscoll, 1 Windmill La., New City, N.Y. 10956

[21] Appl. No.: 886,279

[22] Filed: Mar. 13, 1978

[51] Int. Cl.[2] ..... E06B 7/08

[52] U.S. Cl. ..... 49/403; 24/20 LS

[58] Field of Search ..... 49/403, 371; 24/20 R, 24/20 LS, 20 EE, 22; 292/345

[56] References Cited

U.S. PATENT DOCUMENTS 3,159,708 12/1964 Deal ..... 24/20 LS 3,903,649 9/1975 Dalia ..... 49/403

*Primary Examiner*—Kenneth Downey

*Attorney, Agent, or Firm*—George W. T. Loo

[57] ABSTRACT

A pair of left-end and right-end clips which are each installed with a pop rivet to the left-end portion and right-end portion, respectively, of an existing glass panel of a jalousie or louver. The installed clips each overlaps a panel mounting bracket to prevent the removal of the panel for stealthy, illegal entry into a building. The clips can also be used to secure the panel when the existing brackets are broken.

5 Claims, 8 Drawing Figures

JALOUSIE BURGLAR STOP

BACKGROUND OF THE INVENTION (1) Field of the Invention

Clips for installation on the end portion of slats of existing jalousies to prevent their removal for stealthy, illegal entry into a building and to secure the slats when the end brackets, which hold the slats in place, are broken.

(2) Description of the Prior Art

Dalia, U.S. Pat. No. 3,903,649, dated Sept. 9, 1975, discloses the use of louver security clips which are installed within the end brackets of a louver by removing the panel and possibly cutting the ends of the panel to provide room for the clips. Sakamoto, U.S. Pat. No. 4,027,430, dated June 7, 1977, discloses the use of cover assemblies on the ends of a jalousie slat to prevent surreptitious illegal entry through the jalousie.

My invention provides simple, inexpensive, secure clips to prevent the secret removal of existing jalousie slats without the necessity of removing the slats for their installation, of substituting end brackets, or of shortening the slats.

(3) Prior Art Statement

Dalia, cited above, appears to be the closest prior art of which Applicant is aware. Dalia teaches the adding of a pair of right-end and left-end clips to the ends of already installed louver panels to retain the panels against attempted extraction by a potential intruder. Dalia's clips are installed within the end-mounting brackets in a louver opening by removing a panel from them, cutting the ends of the panel to make room for the end abutment flange of the clips, adding a clip to each end of the panel, and then reinserting the clip carrying panel in the end brackets. Dalia's installed clips are secure only when the louver panels are in a fully closed position. When the louver panels are in an open position, extension tab of the clips can be turned upward to allow the removal of the panels for stealthy, illegal entry into a building.

SUMMARY OF THE INVENTION

The invention relates to a pair of left-end and right-end clips which are each installed to the left-end portion and right-end portion, respectively, of an existing jalousie or louver. The installed clips prevent the removal of the panel for stealthy, illegal entry into a building. They also secure the panel when the existing brackets are broken.

An object of this invention is to provide clips which can be installed on the end portions of existing louver slats to prevent the removal of the slats for stealthy, illegal entry into a building.

Another object of this invention is to provide clips that will secure existing jalousie panels from falling out in high wind conditions or as a safety measure for jalousies installed at great heights when the existing brackets are broken.

Still another object of this invention is to provide clips that will prevent the removal of already installed jalousie slats regardless of whether the slats are in an open or closed position.

Yet another object of this invention is to provide clips that overlap existing end jalousie brackets and are secured in place by use of pop rivets.

A further object of this invention is to provide clips that will secure louver panels when the ends of existing bracket have been broken off.

A still further object of this invention is to provide clips which are easy to install around the end portions of existing jalousie panels and which when installed will prevent intruders from entering a building furtively through the jalousies.

Another object of this invention is to discourage intruders from using jalousies or louvers to gain stealthy, illegal entry into buildings.

Still another object of this invention is to provide the combination of jalousies or louvers with clips that discourage burglars.

Other objects, features and advantages of the present invention will be readily apparent from the following detailed description taken in connection with the accompanying drawing.

DESCRIPTION OF THE PREFERRED EMBODIMENT

Figure 1:
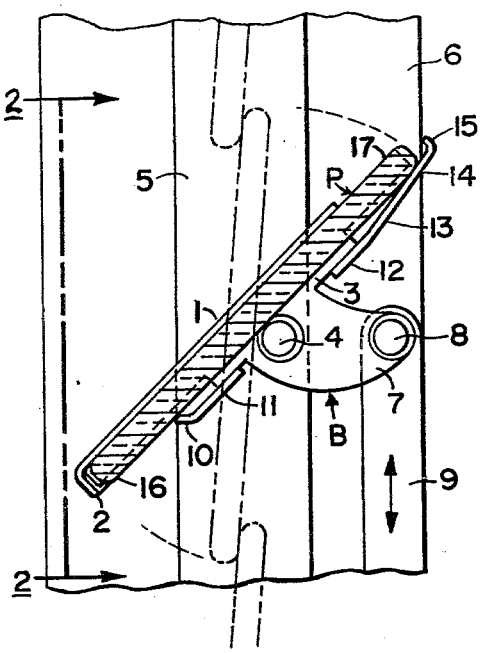
FIG. 1 is a vertical sectional view through a jalousie panel held in an end-mounting bracket in an open position. The closed position of the panel in relation to two other panels is showed in phantom.
Figure 3:
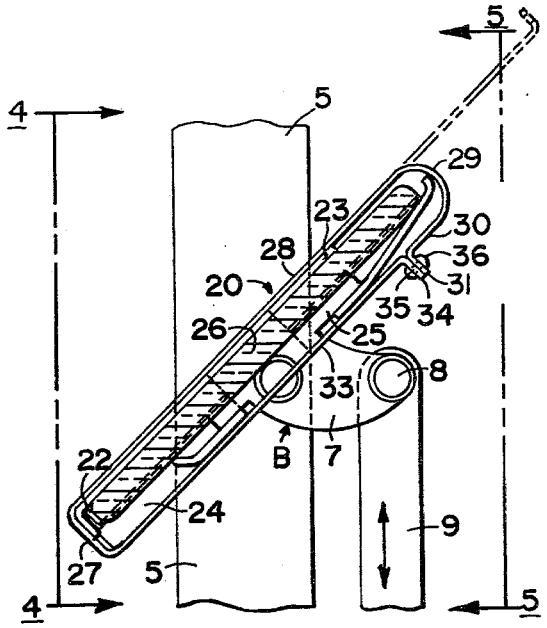
FIG. 3 is a vertical sectional view similar to FIG. 1 of a bracket-mounted panel to which a clip has been added. The bent portion, connector portion and tab are indicated in phantom before they are turned down.
Figure 2:
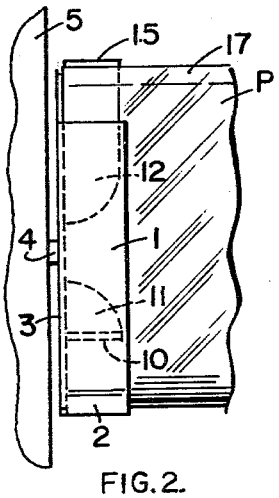
FIG. 2 is an elevational view of the panel when in a closed position looking in the direction indicated by the arrows of line 2—2 of FIG. 1.
Figure 4:
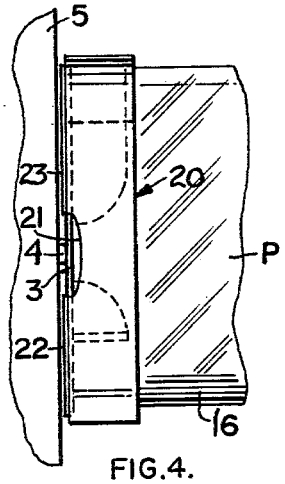
FIGS. 4 and 5 are elevational views of the end portion of the jalousie panel of FIG. 3 viewed from the inner and outer faces looking in the directions indicated by the arrows of lines 4—4 and 5—5, respectively.
Figure 5:
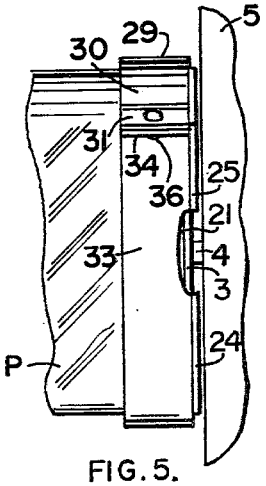

Before explaining the present invention in detail, it is to be understood that the invention is not limited in its application to the details of construction and arrangement of parts illustrated in the accompanying drawing, since the invention is capable of other embodiments and of being practiced or carried out in various ways. Also, it is to be understood that the phraseology or terminology employed herein is for the purpose of description and not of limitation.

Referring now to the drawing wherein like reference numerals or letters refer to like and corresponding parts throughout the several views, the preferred embodiment of the invention disclosed in FIGS. 1 to 8 inclusive includes a pair of left-end and right-end clips 20 and 40, respectively, shaped to engage the respective (left and right) end portions of a panel P.

FIG. 1 shows a jalousie panel mounting bracket B. Bracket B includes an outer strip 1, a ledge 2, an end abutment wall 3 for a glass panel P, a transverse pivot 4 which is received in an anchorage post 5, which post is disposed upright in a generally rectangular jalousie frame 6, a lever arm 7, which is attached at 8 to an upright operating rod 9. Two strips 11 and 13 frictionally bear against the inner face of panel P with resilient force. Strip 11 has a resilient tab 10 disposed to frictionally engage the inner face of panel P. Strip 13 has a lower segment 12 bent inward from the end wall 3 and a resilient segment 14 bent normally toward panel P and formed with a lip 15 which normally overlies the upper longitudinal edge of panel P and serves as a barrier against its upward displacement. When closed, the lower inner edge 16 of panel P overlies (more or less frictionally) the outer, upper margin 17 of panel P immediately beneath it. (See FIG. 1 in phantom)

Present condition of jalousie frames encourage burglaries. In the course of my 15 year work experience in the field of commercial and residential security, I have learned on numerous occasions that intruders have removed glass slats from jalousies and louvers to gain stealthy, illegal entry into buildings. Police departments recommend that occupants glue in glass slats. However, continuous opening and closing of them causes the glued parts to separate so that a sharp blow to the slats will dislodge them from their mounting brackets. An intruder can remove closed glass slats by inserting a screwdriver or a knife blade between the slats to the rear of the bracket, prying open the bracket so that the glass slat may be pushed out, and then pushing out the glass slat. Once a glass slat is removed, the others are readily lifted out by the intruder for easy, secret, and illegal entry into a building.

Figure 6:
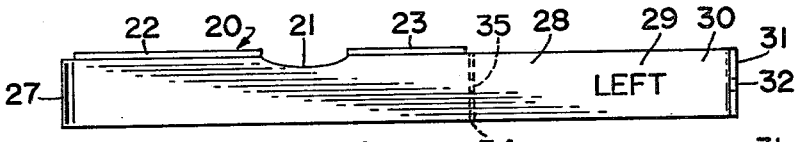
FIG. 6 is a plan view of the left-end clip.
Figure 7:
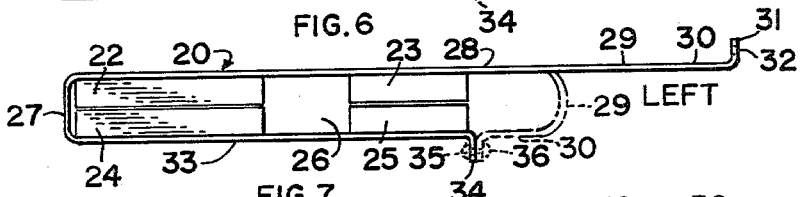
FIG. 7 is a front view of the clip shown in FIG. 6. The turned down position of the bent portion, connector portion and tab are shown in phantom.
Figure 8:
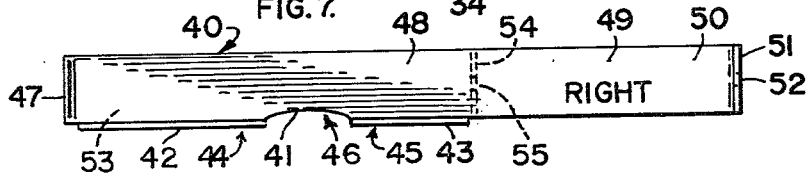
FIG. 8 is a plan view of the right-end clip.

The present invention provides a pair of left-end and right-end clips 20 and 40, respectively, (FIGS. 6–8). They are stamped out of sheet steel or other suitable material and are shaped to engage the respective (left and right) end portions of a panel P. They are each installed with a pop rivet 36. The installed clips each overlaps a panel mounting bracket B to prevent the removal of panel P for stealthy, illegal entry into a building. When brackets B are broken, they can be used to prevent panel P from falling out in high wind condition or as a safety measure for jalousies installed at great heights.

Clip 20 includes two flat strips 28 and 33, which are connected at one of their ends to a U-shaped channel 27. Strip 28 has two upright spaced flanges 22 and 23 along one of its longitudinal edges; strip 33 has two upright spaced flanges 24 and 25 along one of its longitudinal edges. Flanges 22 and 23 are in juxtaposition with flanges 24 and 25, respectively. The inner sides of the flanges along with the facing surfaces of strips 28 and 33 form an opening 26, which is adaptable to cooperate with bracket B. Indentation 21 may be provided for easier installation of clip 20 to bracket B. Bent portion 29 and connector portion 30 are in line with strip 28 while tab 31 is perpendicular to strip 28. Tab 31 has a rivet opening 32. Strip 33 has a tab 34, which is perpendicular to it. Tab 34 has a rivet opening 35.

Clip 40 includes strips 48 and 53, U-shaped channel 47, flanges 42, 43, 44, and 45, opening 46, indentation 41, bent portion 49, connector portion 50, tabs 51 and 54, and rivet openings 52 and 55. Clip 40 is the opposite of clip 20. Clip 20 is a left-end clip and clip 40 is a right-end clip. The corresponding parts of right-end clip 40 is designated by a number which is 20 greater than the corresponding parts of left-end clip 20.

Clip 20 is installed on the left-end portion of an already installed panel P in the following manner: (1) Place clip 20 in overlap relation with bracket B, with bent portion 29, connector portion 30 in line with strip 28 and tab 31 perpendicular to strip 28 as shown in phantom in FIG. 3. (2) Bend bent portion 29 downward over lip 15 and resilient segment 14 to form a U-shaped channel. (3) Aline openings 32 and 35. (4) Secure tabs 31 and 34 together by placing pop rivet 36 through openings 32 and 35. Normally clip 20 is shaped as shown in FIG. 7. However, if it is deemed desirable bent portion 29 may be bent as shown in phantom. If bent portion 29 is bent as shown in phantom, step 2 above may be eliminated. Clip 40 is installed on the right-end portion of already panel P by following the above steps.

When clips 20 and 40 are installed as stated above to panels P of a jalousie, they act as a jalousie burglar stop. The installed clips prevent the removal of panels P regardless of whether the jalousie is open or closed. The only way to remove panels P and gain entry to a building, other than by removing the clips, would be to break enough panels to allow entry by an intruder. Since the breaking of panels would cause a disturbance, an intruder would not break panels to gain entry.

Movement of panels P are not effected by the presence of clips 20 and 40. The jalousie can now be left open without constituting an obvious invitation to an intruder to gain stealthy, illegal entry by pushing panels P out of their brackets B from the outside.

The present invention can also be used to act as a means of repair for broken jalousie brackets. It can be used to prevent glass slats from falling out of brackets in high wind conditions or as a safety measure for jalousies installed at great heights.

Although but a single embodiment of the invention has been disclosed and described herein, it is obvious that many changes may be made in the size, shape, arrangements and detail of the various elements of the invention without departing from the scope of the novel concepts of the present invention.

I claim as my invention:

1. A jalousie burglar stop comprising a clip which is adapted to be installed on the end portion of an existing jalousie panel so as to overlap a panel mounting bracket, the clip includes two flat strips which are connected at one of their ends to a U-shaped channel, each strip has two generally perpendicular spaced flanges along one of its longitudinal edges, the flanges are in juxtaposition with each other and form an opening, which is adapted to cooperate with a panel mounting bracket, the length of the strips are approximately the width of a jalousie panel, a segment extends longitudinally from one strip, the segment has a tab at its end and is adapted to be bent over portions of a panel mounting bracket to form a U-shaped channel and to abut a tab at the other end of the second strip with its tab, the tabs of both strips each has an opening, which is in register with each other when the tabs abut each other.

2. The jalousie burglar stop of claim 1, wherein the segment includes a bent portion, a connector portion, and the tab, the tab is generally perpendicular to the first mentioned strip.

3. The jalousie burglar stop of claim 2, wherein there is an indentation in the first mentioned strip in the vicinity of the first mentioned opening for easier installation of the clip.

4. The jalousie burglar stop of claim 2, wherein the tabs are secured together by a fastening means.

5. The jalousie burglar stop of claim 1, wherein there are two clips, one for the left-end portion of a jalousie panel and the other for the right-end portion of a jalousie panel.

* * * * *